US005236540A

United States Patent [19]

Shi

[11] Patent Number: 5,236,540

[45] Date of Patent: Aug. 17, 1993

[54] TAPING DEVICE

[76] Inventor: Gi Shi, No. 883-1, Sec. 3, Chungshan Rd., Changhua City, Taiwan

[21] Appl. No.: 870,825

[22] Filed: Apr. 20, 1992

[51] Int. Cl.[5] ..... B32B 31/00

[52] U.S. Cl. ..... 156/523; 156/527; 156/574; 156/579; 7/158

[58] Field of Search ..... 156/523, 527, 574, 579; 7/107, 158, 170; 225/7; 242/84.8

[56] References Cited

U.S. PATENT DOCUMENTS 2,410,713 11/1946 Carlson ..... 242/84.8
2,447,519 8/1948 Marinsky ..... 225/7
2,750,029 6/1956 Morgan ..... 225/7
3,812,588 5/1974 Bennett ..... 242/84.8 X
4,722,140 2/1988 Miceli ..... 7/158 X
5,040,256 8/1991 Mills ..... 7/170 X

*Primary Examiner*—David A. Simmons
*Assistant Examiner*—James J. Engel, Jr.
*Attorney, Agent, or Firm*—W. E. Pelton

[57] ABSTRACT

A taping device including a member rotatably supported on a frame for supporting a tape, a roller rotatably supported on the frame, a presser including a handle extended downward through a slot formed in the bottom of the frame and including a panel engageable with the roller, and a resilient element for biasing the panel of the presser toward the roller so as to retain the tape in place, the panel can be separated from the roller when the handle of the presser is pulled against the resilient element.

7 Claims, 5 Drawing Sheets

TAPING DEVICE

BACKGROUND OF THE INVENTION

1. Field of the Invention

The present invention relates to a taping device, and more particularly to a taping device for packaging purposes.

2. Description of the Prior Art

A typical taping device is shown in FIG. 6 and includes a frame 90 having a grip 91 extended downward therefrom and having a member 92 rotatably disposed thereon for supporting a tape 93, a roller 94 a guiding means 95, a cutting means 97 disposed on the frame 90 for guiding and cutting the tape, and a stop 96 for guiding the movement of the tape. However, the tape, after being cut by the cutting element 97, is apt to be drawn backward away from the roller 94 such that the user has to insert the free end of the tape through the space formed between the roller 94 and the stop 96 after every packaging operation. This is inconvenient because the stop 96 is stably fixed in place such that the tape can not be easily inserted through the roller 94 and the stop 96.

The present invention has arisen to mitigate and/or obviate the afore-described disadvantages of the conventional taping devices.

SUMMARY OF THE INVENTION

The primary objective of the present invention is to provide a taping device in which tape can be easily inserted through the roller and can be stably retained in place.

In accordance with one aspect of the invention, there is provided a taping device comprising a frame fixed on a grip, a member rotatably supported on the frame for supporting a tape, and a roller rotatably supported on the frame. The frame includes a bottom portion having a slot formed therein, a presser including a handle extended downward through the slot of the frame and including a panel engageable with the roller, and means for biasing the panel of the presser toward the roller. The panel is thereby separated from the roller when the handle of the presser is pulled against the biasing means such that a free end portion of the tape is easily insertable through the space formed between the roller and the panel of the presser, and the free end portion of the tape is retained in place by the presser when the handle is released.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
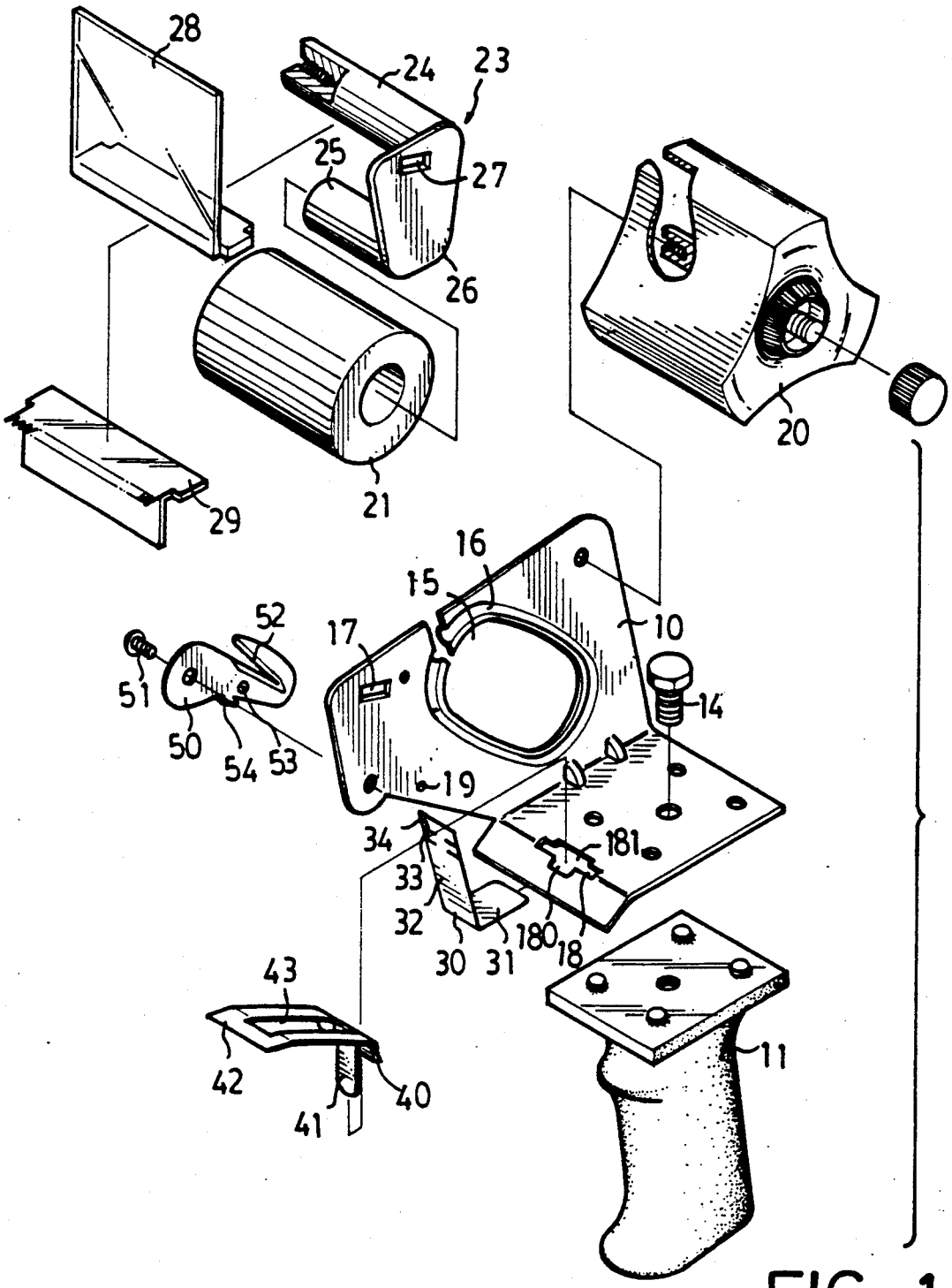
FIG. 1 is an exploded view of a taping device in accordance with the present invention.
Figure 2:
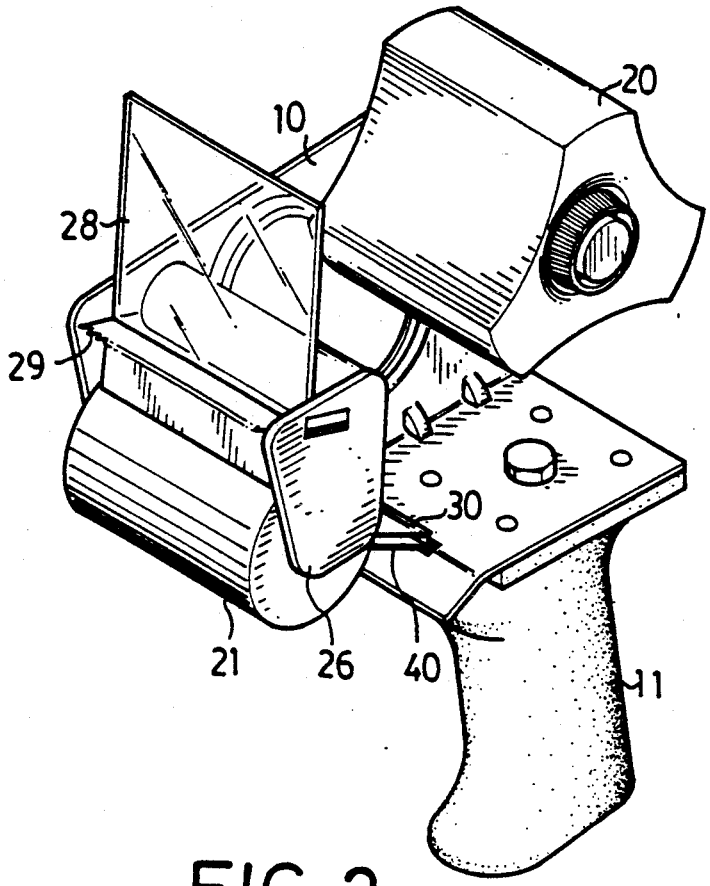
FIG. 2 is a perspective view of the taping device.
Figure 3:
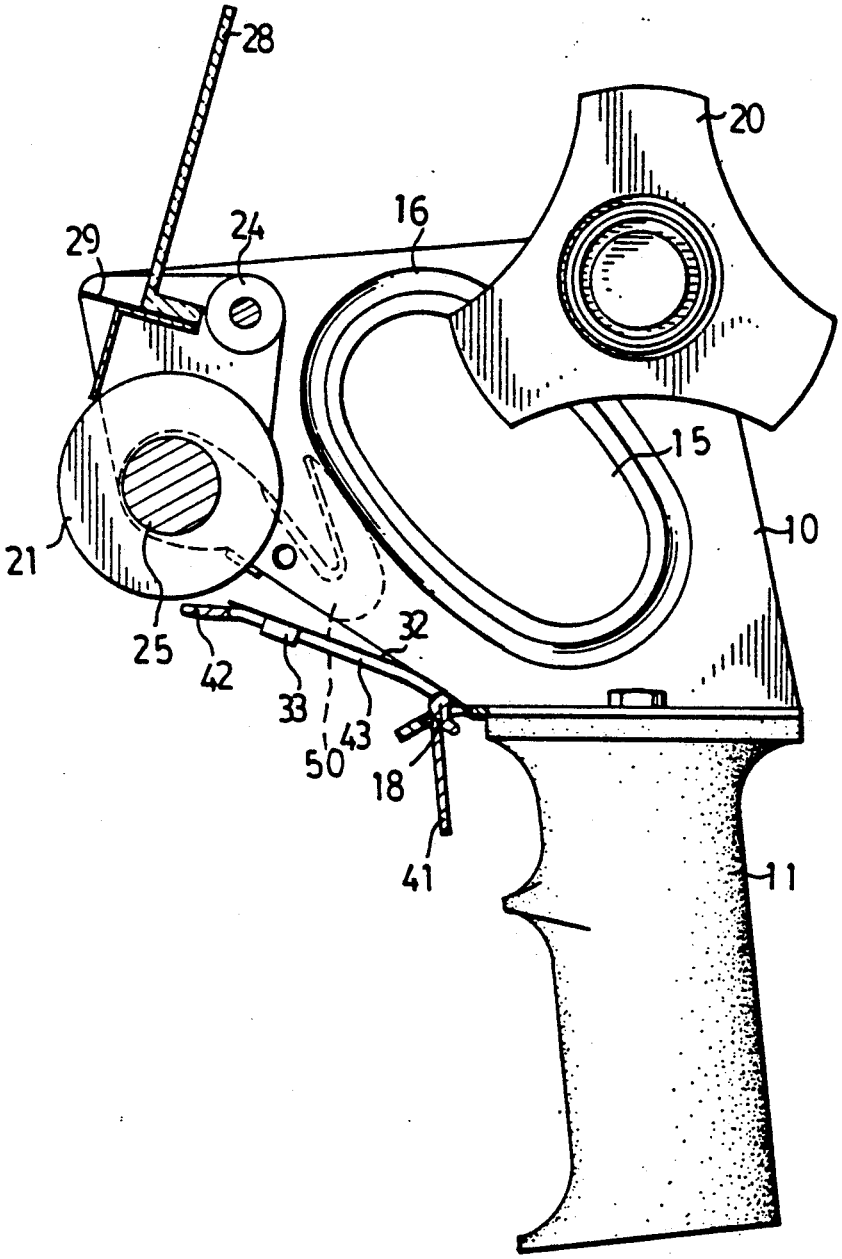
FIG. 3 is a plane view of the taping device.

Referring to the drawings, and initially to FIGS. 1, 2 and 3, a taping device in accordance with the present invention comprises generally a frame 10 having a grip 11 fixed on the bottom portion by means such as bolts 14. An opening 15 is formed in the frame 10 for lightening purposes and a rib 16 is formed around the perimeter of the opening 15 for reinforcement purposes. An aperture 17 is formed in the frame 10. A slot 18 is formed in the bottom portion of the frame 10 and two notches 180, 181 are oppositely formed in the middle portion of the slot 18.

Figure 4:
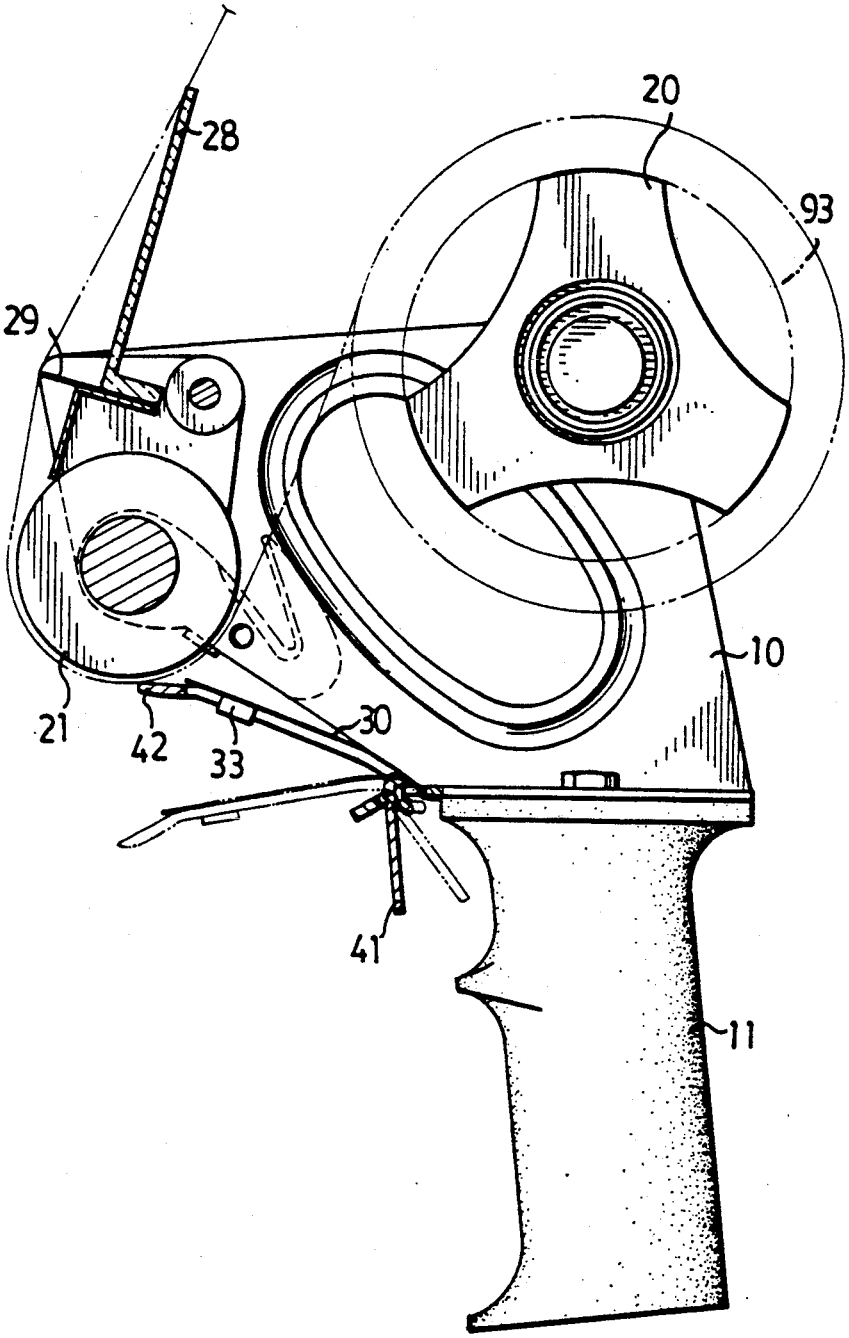
FIG. 4 is a plane view illustrating the operations of the taping device.
Figure 6:
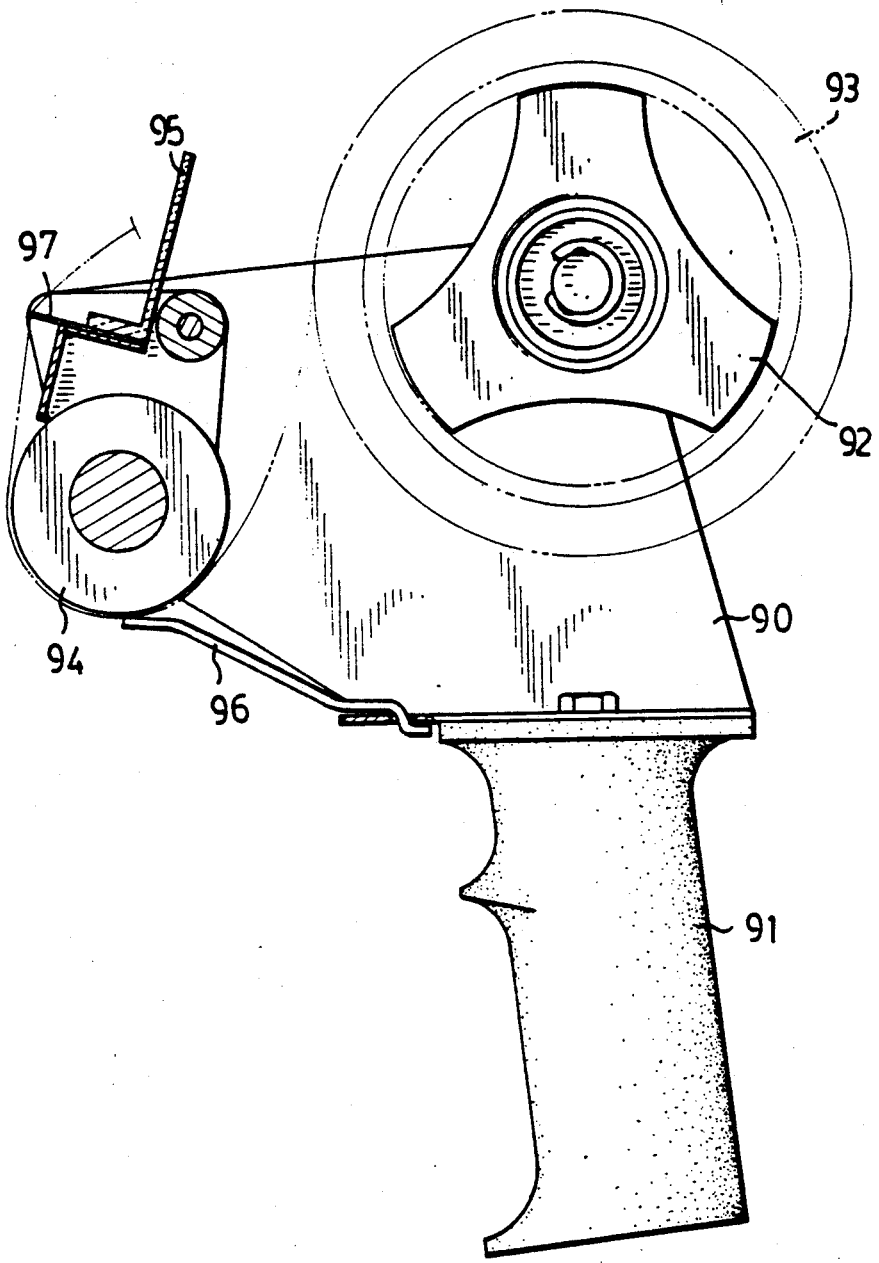
FIG. 6 PRIOR ART
FIG. 6 is a plane view illustrating a conventional taping device.

A member 20 is rotatably supported on the frame 10 for supporting the tape 93 (FIG. 4). A roller 21 is rotatably coupled to the frame 10 by a support 23 which includes two legs 24, 25 coupled together by a board 26, in which the leg 24 is fixed to the frame 10 by means such as screws and the roller 21 is rotatably supported on the other leg 25. An aperture 27 is formed in the board 26. A guiding means includes a panel 28 and a cutting element 29 fixed together and fixed in a conventional way to the frame 10. The guiding means includes end portions engaged in the apertures 17, 27.

A resilient element 30 is L-shaped including a first leg 31 inserted through the slot 18 of the frame 10 and a second leg 32 extended upward from the bottom of the frame 10. The abutment portion of the legs 31, 32 engages the notch 181. Two flaps 33 are oppositely formed in the upper portion of the second leg 32 of the resilient element 30 and each is formed by a pair of cuts 34 such that the flaps 33 can be bent relative to the second leg 32. A presser 40 includes a handle 41 extended downward through the slot 18 and engaged in the notch 180 and a panel 42 having a cavity 43 formed therein. The flaps 33 of the resilient element 30 are engaged in the cavity 43 of the presser 40 such that the panel 42 of the presser 40 can be biased upward by the resilient element 30 to engage with the roller 21, best shown in FIG. 3, in order to bias the tape 93 in place (FIG. 4). The panel 42 can be caused to move away from the roller 21 when the handle 41 is pulled toward the grip 11 by the user such that the free end of the tape can be easily threaded or inserted through the space formed between the roller 21 and the presser 40.

Figure 5:
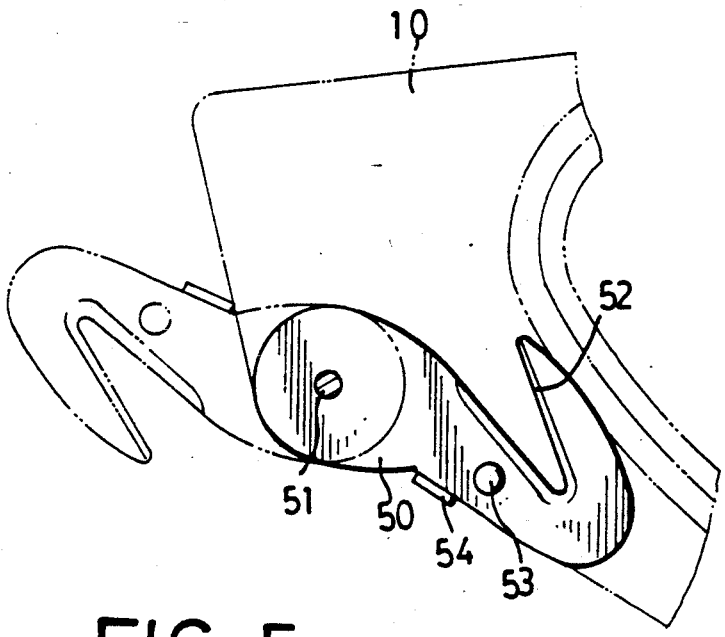
FIG. 5 is a schematic view illustrating a wire cutter.

Referring next to FIG. 5 and again to FIG. 1, a cutter 50 includes a first end pivotally coupled to the frame 10 by means such as a screw 51 and includes a V-shaped cutting edge 52 formed in the second end thereof. A wire or a rope for packaging purposes can be cut by the cutting edge 52. A protrusion 53 is formed on the cutter 50 for engagement with a depression 19 formed in the frame 10 such that the cutter 50 can be retained in the protective position as shown in solid lines in FIG. 5. A knob 54 is formed on the cutter 50 such that the cutter 50 can be pulled outwards of the frame 10 to a working position as shown in dotted lines in FIG. 5.

In use, as shown in FIG. 4, the free end portion of the tape 93 can be easily threaded through the space formed between the roller 21 and the presser 40 when the handle 41 is pulled by the user, and the tape 93 can be stably retained in place by the presser 40 when the handle 41 is released.

Accordingly, the tape can be easily engaged in the taping device in accordance with the present invention and can be stably retained in place by the presser.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A taping device comprising a frame fixed on a grip, a member rotatably supported on said frame for supporting a tape, a roller rotatably supported on said frame, said frame including a bottom portion having a slot formed therein, a presser including a handle extended downward through said slot of said frame and including a panel engageable with said roller, and means for biasing said panel of said presser toward said roller, said panel of said presser including a cavity formed therein, said biasing means including a first leg engaged in said slot of said frame and a second leg extended upward from said bottom portion of said frame, said second leg including at least one flap formed therein for engagement in said cavity of said panel such that said presser is biased by said biasing means; whereby, said panel is separated from said roller when said handle of said presser is pulled against said biasing means such that a free end portion of said tape is easily insertable through the space formed between said roller and said panel of said presser, and said free end portion of said tape is retained in place by said presser when said handle is released.

2. A device according to claim 1, wherein said bottom portion of said frame includes a notch formed therein and communicated with said slot for engagement with an abutment portion of said first leg and said second leg of said biasing means.

3. A device according to claim 1, wherein said bottom portion of said frame includes a notch formed therein and communicated with said slot for engagement said handle of said presser.

4. A taping device comprising a frame fixed on a grip, a member rotatably supported on said frame for supporting a tape, a roller rotatably supported on said frame, said frame including a bottom portion having a slot formed therein, a presser including a handle extended downward through said slot of said frame and including a panel engageable with said roller and having a cavity formed therein, and a biasing means including a first leg engaged in said slot of said frame and a second leg extended upward from said bottom portion of said frame, said second leg including at least one flap formed therein for engagement in said cavity of said panel so as to bias said panel of said presser toward said roller, whereby, said panel is separated from said roller when said handle of said presser is pulled against said biasing means such that a free end portion of said tape is easily insertable through the space formed between said roller and said panel of said presser, and said free end portion of said tape is retained in place by said presser when said handle is released.

5. A device according to claim 4, wherein said bottom portion of said frame includes a notch formed therein and communicated with said slot for engagement with an abutment portion of said first leg and said second leg of said biasing means.

6. A device according to claim 4, wherein said bottom portion of said frame includes a notch formed therein and communicated with said slot for engagement said handle of said presser.

7. A device according to claim 4 further comprising a cutter having a first end pivotally coupled to said frame and having a cutting edge formed in a second end thereof, a protrusion formed on said cutter, said frame including a depression formed therein for engagement with said protrusion of said cutter such that said cutter is retained in a protective position, and a knob formed on said cutter such that said cutting edge of said cutter can be pulled away from said frame.

* * * * *